United States Patent [19]

Krikorian

[11] Patent Number: 4,533,056

[45] Date of Patent: Aug. 6, 1985

[54] SHELF AND BRACKET THEREFOR

[76] Inventor: George Krikorian, 39 Camp St., Paxton, Mass. 01612

[21] Appl. No.: 579,506

[22] Filed: Feb. 13, 1984

[51] Int. Cl.[3] ..... A47F 5/00

[52] U.S. Cl. ..... 211/153; 211/134

[58] Field of Search ..... 211/134, 106, 181, 153, 211/90, 186, 187

[56] References Cited

U.S. PATENT DOCUMENTS 1,830,230 11/1931 Gwyer ..... 211/153 X 2,198,584 4/1940 Swakly ..... 211/106 X 2,287,611 6/1942 Harbison ..... 211/134 X 3,321,089 5/1967 Krikorian ..... 211/134

*Primary Examiner*—Ramon S. Britts

*Assistant Examiner*—Sarah A. Lechok

*Attorney, Agent, or Firm*—Charles R. Fay

[57] ABSTRACT

An open wire shelf and supporting brackets wherein the shelf has longitudinal wires to enter and be gripped by depressions in the brackets so as to be removable and adjusted to three positions of different extent from a support for the brackets.

2 Claims, 4 Drawing Figures

SHELF AND BRACKET THEREFOR

BACKGROUND OF THE INVENTION

This invention is an improvement on that shown in U.S. Pat. No. 3,321,089, May 23, 1967. While the structure therein has proved practical and is a commercial success, especially for display of consumer goods, e.g. shoes, it tended to allow some goods to drop through the shelf; i.e., between the wire members or strands 18, 20 and 24 therein. Should these openings be closed as by plates, boarding, etc., the spring action of such members in grasping the brackets (which see FIG. 3 in the patent) would be unobtainable and lost. Therefore, a novel interassociation between new brackets and altered shelving is presented herewith.

SUMMARY OF THE INVENTION

In order to adequately support for display such small items as baby shoes, etc., the new shelf has applied thereto a series of longitudinal wire strands or members in at least certain portions thereof, and the brackets are provided with upstanding elements each in the form of an e.g. bight of a hook so that they may extend through the mesh of the multiple, wire members or strands and spring hold the shelf for a firm and steady structure capable of holding relatively heavy loads in at least three positions of adjustment relative to the upright supports upon which the brackets are removably mounted.

PREFERRED EMBODIMENT OF THE INVENTION

Figure 1:
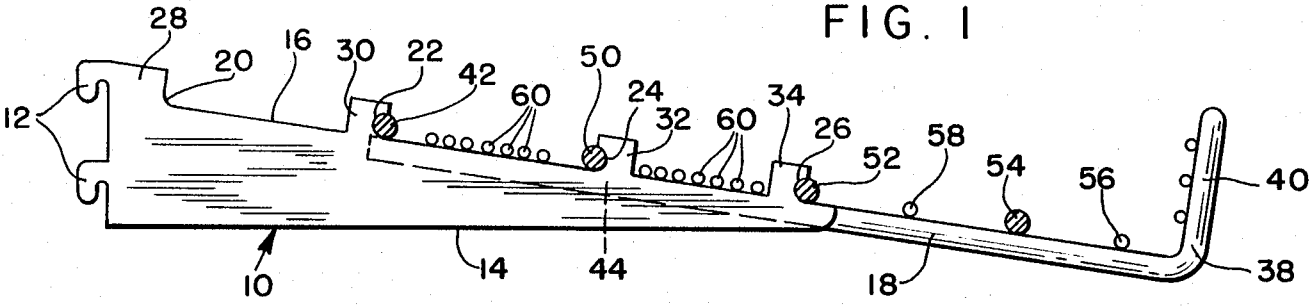
FIG. 1 is a side elevational view of one of the new brackets with the shelf shown in one adjusted position, parts being in section.

The bracket is indicated at 10. It has hooks 12 to temporarily hold it generally horizontally to a support, as well-known. The bracket is generally triangular so that when mounted it has a more or less horizontal lower edge 14, and an upper edge 16 that trends down to the right so as to hold a wire shelf 18 also trending down to the right to better display goods and make them easier to pick up. The bracket has essentially four hook bight-like indentations as at 20, 22, 24 and 26. The indentations 20, 22 and 26 all face to the right; i.e., downhill, and that at 24 is reversed. Indentation 20 is formed in material 28 of the body of the bracket and clearly the shelf cannot be positioned except to the right of this indentation. The indentations 22, 24, and 26 are all formed on small projections 30, 32 and 34 that rise above the upper edge 16 of the bracket. These projections are just big enough to form fixed, immovable members. The important dimensions are those in line and plane with the brackets 10, to provide for application of the shelf thereto.

The shelf comprises an outer circumferential heavy wire 38 including the upstanding lower lip at 40. It has a rear longitudinal reach 42 secured e.g. by welding to two side pieces 44, 46 these bending into the lip 40.

There are four longitudinal and equally spaced heavy wires 42, 50, 52, and 54 on top of the wires 38, 44, and 46, which serve to connect the shelf to the brackets. There is a relatively short longitudinal space between the lip 40 and projection 34, and a small longitudinal wire 56 may be placed intermediate the same. A similar wire 58 may be placed between heavy wires 52 and 54. Preferably, there are smaller closely spaced wires 60 parallel to and between heavy wires 50 and 42 and between heavy wires 52 and 50. These prevent passage of articles such as ladies' shoe heels.

In order to apply the shelf to the brackets, it is necessary to snap the rear heavy wire 42 into bight 22 and heavy wire 50 into bight 24, and at the same time, heavy wire 52 into bight 26, as shown in FIG. 1. This is but one position of the shelf relative to the support for the hooks 12, but the dimensions are such that this makes a solid, firm shelf support that does not allow the shelf to wabble, with at least two spaced brackets. The word "snap" is used because of the slight spring in the heavy wires that allows or provides this function.

Figure 2:
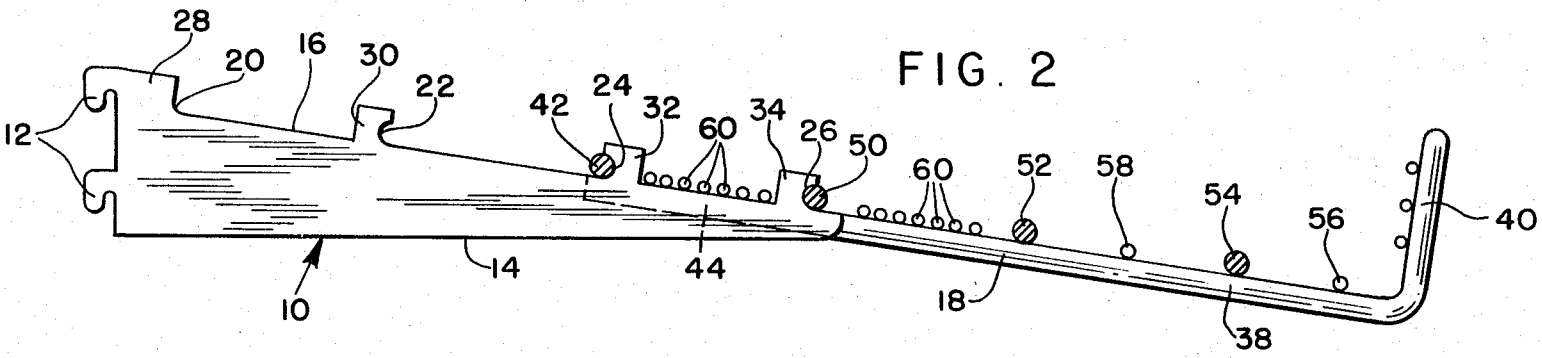
FIG. 2 is similar to FIG. 1, but showing the shelf in another of its three positions of adjustment.
Figure 4:
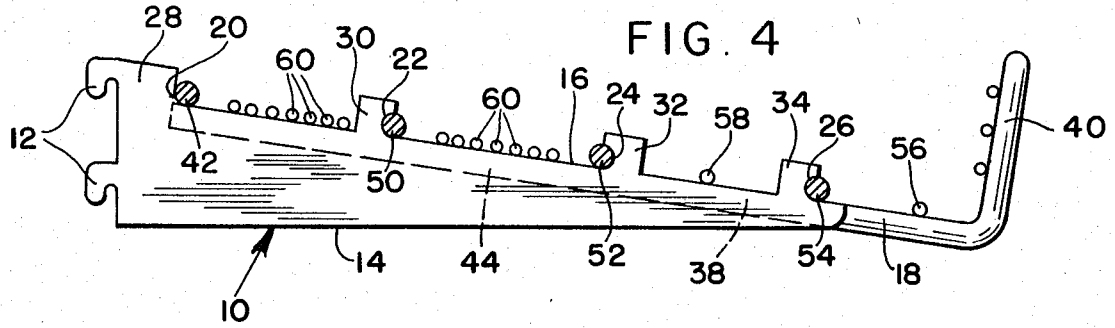
FIG. 4 is a view similar to FIG. 1 showing a third shelf adjustment.
Figure 3:
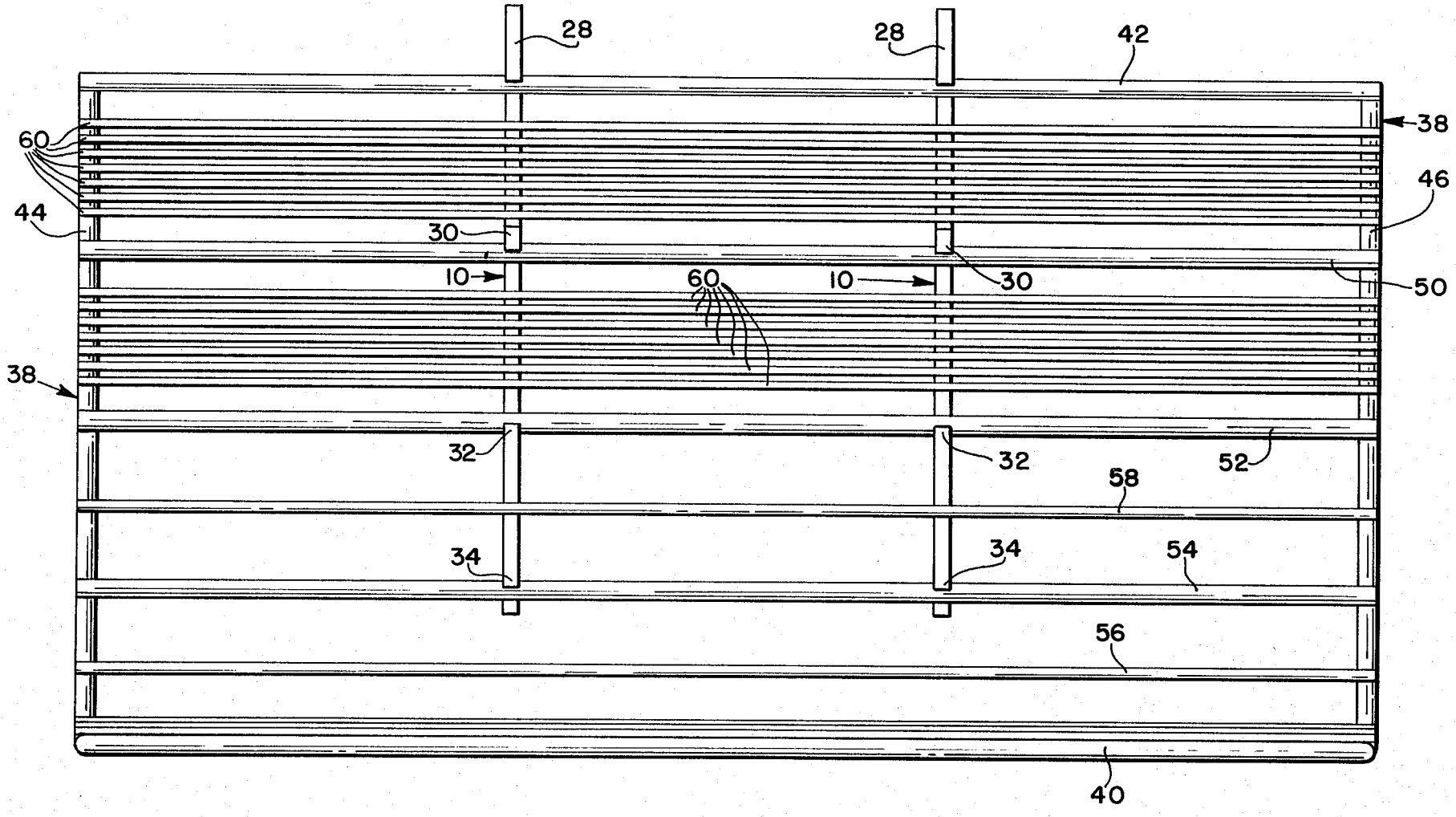
FIG. 3 is a plan view thereof, parts being broken away.

The shelf may be removed from the FIG. 1 position and applied closer to hooks 12 with rear wire 42 in bight 20, FIG. 4, or farther out with wire 42 in bight 24, FIG. 2. In all cases, the shelf is tight and firm and cannot be accidentally dislodged.

I claim:

1. A wire shelf and bracket therefor comprising an open wire frame including a rear longitudinal wire and several mutually spaced longitudinal wires of like diameter, crosswires fixed and connecting the rear and several wires, the bracket comprising a rigid elongated member, projections on an edge thereof, said projections being adapted to extend from one side of the wires to the other, each projection including a curved edge forming a bight, a pair of bights facing each other, and being apart a distance to springily receive two of the wires, and a third bight facing oppositely and springily receiving a third wire, said bights fixing the shelf to the bracket, the bracket being positioned under the shelf, the projections rising through the shelf, a series of wires parallel to the first named wires and lying between certain pairs thereof in mutually evenly spaced relation, the last named series of wires being smaller in diameter and more closely spaced than the first named wires and certain of the series of wires being fixedly spaced from certain of the first named wires to a degree to just allow the entry of certain projections therebetween to provide for snapping the first named wires to the projections and to act to aid in preventing accidental dislodgement of the brackets, both series of wires being in fixed relation to each other.

2. A rectangular wire shelf and bracket therefor comprising, an open wire frame having a rectangular continuous wire perimeter of a wire of a first diameter, including a front, rear, and end elements, several wires of similar diameter within the frame and extending longitudinally thereof in mutually spaced relation and extending from one end element to the other, said several wires forming longitudinal spaces in the frame, certain of the spaces being of uniform width, a series of closely spaced wires of smaller diameter located in mutually spaced relation in the space closest to the rear element and in the space next to said last named space, said closely spaced wires forming floors for said last named space and the space closest thereto, there being relatively narrow spaces between the rear element and the next adjacent wire of smaller diameter and like narrow spaces between some of the wires of similar diameter and adjacent wires of smaller diameter, a bracket of flat material with a wider end and a narrower end, four projections on an edge of the bracket, said projections each having a depression for receiving certain ones of the rear element and the wires of similar diameter to hold the shelf to the bracket in three different locations along the bracket in adjusted degrees of extension relative to the bracket, three of the depressions in the four projections facing the narrow end thereof, and one depression facng oppositely thereto so as to face on the three said depressions, and three of the projections having widths in the planes of the projections and of the bracket of dimensions facilitating the entry of the projections through the shelf between the respective wires of similar diameter and the adjacent wires of smaller diameter to provide for the wires of similar diameter to be gripped in certain depressions of certain projections to support the shelf in three adjustments on the bracket in the direction of the narrow width of the shelf.

* * * * *